US005952627A

United States Patent [19]

Park

[11] Patent Number: 5,952,627

[45] Date of Patent: Sep. 14, 1999

[54] APPARATUS AND METHOD FOR DETECTING MALFUNCTION OF HALL FIXTURES IN AN ELEVATOR

[75] Inventor: Sung Jun Park, Seoul, Rep. of Korea

[73] Assignee: LG Industrial Systems Co., Ltd., Seoul, Rep. of Korea

[21] Appl. No.: 09/054,466

[22] Filed: Apr. 3, 1998

[30] Foreign Application Priority Data

Apr. 3, 1997 [KR] Rep. of Korea ..... 97-12294

[51] Int. Cl.[6] ..... B66B 1/28; B66B 1/34

[52] U.S. Cl. ..... 187/393; 187/247

[58] Field of Search ..... 187/391, 393, 187/395, 396, 247

[56] References Cited

U.S. PATENT DOCUMENTS

| | | | |
|---|---|---|---|
| 4,106,593 | 8/1978 | Otto et al. | 187/29 R |
| 4,646,058 | 2/1987 | Mandel et al. | 187/100 |
| 4,650,037 | 3/1987 | Husson et al. | 187/130 |
| 5,487,448 | 1/1996 | Schollkopf et al. | 187/247 |

*Primary Examiner*—Robert E. Nappi

[57] ABSTRACT

An apparatus and method for detecting malfunctions of car-related hall fixtures and care fixtures in a distributed malfunction detecting system, includes at least one elevator controller, each elevator controller having an automatic mode selection switch for providing an automatic repair & malfuction detection mode interrupt request signal, a main controller for providing a car-related hall fixture enable signal and an automatic repair & malfuntion detection mode operation start command upon receipt of the automatice repair & malfunction detection mode interrupt request signal from the elevator controller and for providing a car-related hall fixture disable signal upon receipt of an automatic repair & malfunction detection mode operation completion signal, and a plurality of hall indicator controllers for performing an automatic repair & malfunction detection mode operation by testing corresponding car-related hall fixtures according to predetermined programs upon receipt of the car-related hall fixtures enable signal and the automatic repair & malfunction detection mode operation start command from the main controller and for providing the automatic repair & malfunction detection mode operation completion signal to the main controller when the automatic repair & malfunction detection mode operation is completed.

14 Claims, 5 Drawing Sheets

APPARATUS AND METHOD FOR DETECTING MALFUNCTION OF HALL FIXTURES IN AN ELEVATOR

BACKGROUND OF THE INVENTION

1. Field of the Invention

The present invention relates to an apparatus and its method for detecting malfunctions of a plurality of car-related hall fixtures by communicating among a main controller, a plurality of hall indicator controllers, a plurality of elevator controllers with the main controller as a master station, and more particularly to an apparatus and a method for automatically detecting malfunctions of a plurality of car-related hall fixtures and car fixtures in a distributed malfunction detecting system where elevator cars are controlled to operate separately from each other, whereby if an elevator maintenance officer wishes to either perform a regular or irregular check up on, or repair malfunctioning parts, a malfunction-detection operation can be automatically accomplished according to the specified malfunction detection program without a need for an elevator maintenance officer to activate a plurality of car related hall fixtures such as hall lanterns, hall position indicators, hall buttons, and hall lamps at every floor landing to be flickered, illuminated, or sounded one by one with an additional activation device in order to determine as to whether or not it is malfunctioning, resulting in making the malfunction-detection operation easy and prompt to complete.

2. Description of the Background Art

As a technology for elevator control systems advances, and becomes broadly available, buyers of elevator systems have directed their attention to how effectively and easily an elevator system maintenance can be done rather than to the level of technology used in elevator system. Accordingly, how efficiently an elevator system can be installed and maintained appears to be an essential factor in enhancing competitive power in the market.

As an example, a 4 elevator car group is installed in a 15-storey building. The elevator-car-related hall fixtures on each floor landing are: 4 hall position indicators showing an arbitrary number indicative of a current service floor of the elevator car, 8 travelling direction indicating lamps (including Up and Down lamps) for indicating the travelling direction of the respective elevator car, 8 car arrival indicating lanterns (including Up and Down lanterns) indicating the imminence of an elevator car arrival, 4~8 hall call button lamps (including Up and Down lamps) indicating hall call generation and hall call registration, and 4 hall chime bells for notifying the arrival of the elevator car to the service floor landing. In the building, the total number of elevator-car-related hall fixtures amounts to between 240 and 360.

A conventional malfunction detecting apparatus for such an elevator system is operated in such a manner that the maintenance officer has to activate, on one by one basis, every car-related hall fixtures to check whether or not it is malfunctioning. The maintenance officer often feels burdened in carrying out the malfunction-detecting job, since car-related hall fixtures are installed at every floor landing and are huge in number, resulting in that abandonment or incompletion of the job by the maintenance officer. Often, the maintenance officer inspects only safety-related elements or devices such as elevator controllers and door opening/closing related devices, which are essential for the safety operation and are not many in number.

In other words, the safety-related devices having the highest priority among devices or elements in an elevator system are checked up every time for a possible malfunction. However, car-related hall fixtures and car fixtures which are more easily noticeable to elevator car passengers are not always checked by the maintenance officer because these fixtures are so many in number and have to be activated on a one by one basis to determine whether or not they are malfunctioning with the conventional malfunction detecting apparatus. The conventional malfunction detecting apparatus and its method make the malfunction detecting process very time consuming and uneasy. As a result, the passengers may often find out about several malfunctioning elements on both car-related hall fixtures and car fixtures, and feel be alarmed or annoyed by them. passengers find out those malfunctioning elements not still fixed in spite of regular check-ups done by the building maintenance officer, they may start to distrust of the elevator manufacturing company on that.

FIG. 1 is a block diagram showing a construction of a conventional malfunction detecting apparatus. Referring to FIG. 1, the conventional malfunction detecting apparatus includes an elevator controller 1 for performing overall elevator-related signaling and motion functions; a plurality of hall indicator controllers 2A, 2B for transmitting a hall call request signal generated from a hall call button lamp 5A, 5B through a transmission line L1 to the elevator controller 1, for receiving indication control data from the elevator controller 1, processing the control data, transmitting processed indication-related data to respective car-related hall fixture among hall position & up/down direction indicators 3A, 3B, car arrival indicating hall lanterns 4A, 4B, hall call button lamps 5A, 5B, and hall chime bells 6A, 6B; an oncage controller 7 installed at the ceiling of an elevator car for transmitting through a transmission line L2 to the elevator controller 1 the various data entered from various switches and sensors; an incage controller 8 installed inside of an elevator car 9 for transmitting through the transmission line L2 to the elevator controller 1 the various data entered from various switches and a car call button, and for controlling display operations of car fixtures for car position and travelling direction; and the elevator car (or car) 9.

The operation of a conventional malfunction detecting apparatus with the above-described construction will be described with reference to FIG. 1. First of all, when a passenger presses the hall call button lamp 5A to call the elevator car, the hall call request signal is registered. At this time, the hall indicator controller 2A recognizes that the hall call request signal is registered in response to an incoming hall call request signal transmitted from the hall call button lamp 5A, and then transmit the data to the elevator controller 1 through the transmission line L1. The elevator controller 1 determines and select an optimum elevator car, then sends "car sending data" to the selected elevator car instructing the car to travel to the destination floor, at the same time determines the current floor position and up/down travelling direction of the selected car 9 upon the receipt of output data from the oncage controller 7, and then transmits those data to the hall indicator controller 2A, 2B.

The hall indicator controller 2A, 2B at every floor thereafter controls the car-related hall fixtures such as the hall position & up/down direction indicator 3A, 3B, car arrival indicating hall lanterns 4A, 4B, hall call button lamps 5A, 5B, and hall chime bells 6A, 6B to display, indicate, flicker, illuminate, and sound respectively depending on the data received through the transmission line L1 so that the passenger who called the elevator car may easily know that the elevator system has responded to his or her call and that the responding elevator car is approaching to the respective floor landing at which passengers are waiting for the elevator car.

The car door key opened when the car 9 arrives at the destination floor. The passengers enter the car 9, then press the button corresponding to the destination floor, e.g., a service floor. The car call request data is generated based on the pressed button. The car call request data is fed into the elevator controller 1 via the incage controller 8. The elevator controller 1 determines and selects the optimum elevator car 9 by comparing each elevator car message with the reference data, and sends to the selected car "car sending data" instructing it to travel to the destination floor. The elevator controller 1 simultaneously sends a control signal via the incage controller 8 to the car fixtures such as a car position indicator and an up/down direction indicator disposed on the wall of the elevator car 9 to display the corresponding data respectively. The car position and the up/down direction indicators display the corresponding data respectively.

On the other hand, if the elevator maintenance officer sets the elevator system at a repair & malfunction-detection mode, the elevator controller 1 recognizes that the elevator system is set to the repair & malfunction detecting mode, and hence, transmits a corresponding control signal to a plurality of hall indicator controllers at every floor through the transmission line L1 so that every hall indicator controller stops its current operations. The car-related hall fixtures at every floor landing thereafter also stop their current display operations. Both hall call button lamps 5A,5B and car call buttons are also prevented from generating hall call and car call signals, respectively, so as to prevent passengers from entering any elevator car selected to test for malfunction during the repair & malfunction detecting mode.

As described above, the conventional malfunction detecting apparatus prevents passengers from entering certain elevator cars by deactivating displays of every kind of car-related hall fixtures as well as car fixtures during the malfunction detecting process. However, since every car-related hall fixtures as well as car fixtures are turned off in the malfunction detecting mode, the maintenance officer may not be able to activate them to determine whether or not they are malfunctioning. In the conventional apparatus, the maintenance officer tests hall and car fixtures using a separate tester to selectively activate each of them, instead of using an existing elevator communication system. Otherwise, the maintenance officer performs the malfunction detection job after converting the elevator system mode from the repair & malfunction-detecting mode to the normal operation mode in which the car-related hall fixtures as well as car fixtures can be activated with the use of the existing elevator communication system. This allows the maintenance officer to check whether or not the hall and car fixtures are malfunctioning without the use of a seperate tester. However, the maintenance officer still need to activate a plurality of car-related hall fixtures and car fixtures on a one by one basis even in the normal operation mode.

The conventional malfunction detecting apparatus with the above-described construction entails the following disadvantages. In order to accomplish the repair & malfunction detecting task, the maintenance officer first sets the elevator system in the repair & malfunction-detecting mode, converts the system operation mode from the repair & malfunction-detection mode to the normal operation mode, and then activates every car-related hall fixtures (e.g.,) in a 15-storey building having 4 elevator car group, the total number of car related hall fixtures is between 240 and 360) as well as car fixtures on each floor one by one. As a result, the repair and the malfunction detecting task according to prior art is complicated and very much time consuming to complete. Because of these disadvantageous operating characteristics of the prior art described above, a malfunction detecting job is usually not performed completely, especially specially for a plurality of car-related hall fixtures, deteriorating the quality of an elevator system and causing dissatisfaction on the users of the elevator system is not provided. The passengers of the elevator system therefore may not be satisfied with the quality of the elevator system.

SUMMARY OF THE INVENTION

The present invention is directed to overcoming the above-described disadvantages. An object of the present invention is to provide an apparatus and a method for detecting malfunctions of hall fixtures in which a malfunction detecting task can be performed either in a manual repair & malfunction detection mode or in an automatic repair & malfunction detection mode depending on the intention of the maintenance officer, and in which if the automatic malfunction detecting mode is selected, the malfunction-detecting process is automatically performed on car-related hall fixtures simply using an existing elevator communication system. Moreover, each of a plurality of car-related hall fixtures and car fixtures is sequentially activated using a previously stored specific program, simplifing the repair and malfunction detecting task, reducing the time spending for performing the task, and hence, maintaining the good quality of the elevator system.

In order to achieve the above-described and other object, according to the present invention, there is provided an apparatus for detecting malfunctions of car-related hall fixtures and of car fixtures in a distributed malfunction detecting system, in which if a repair & malfunction detection mode is set in the system, display functions of a plurality of car-related hall fixtures are disabled and of car fixtures so as to prevent a plurality of passengers from entering into the selected elevator car at any floor comprising: an elevator controller having an automatic malfunction detection mode selection switch for selecting an automatic malfunction detection mode depending on the maintenance officer under the repair & malfunction detection mode for providing a maintenance person with selection between them, and for generating/transmitting an Automatic repair & malfunction detecting mode Interrupt Request signal AIR to, a main controller upon the receipt of an incoming respective signal from the automatic/manual mode selection switch; the main controller for checking outputs from the elevator controller at predetermined interval of time, for generating/transmitting a car related hall fixture enable signal EN along with a malfunction detecting operation start command ST to a hall indicator controller in response to the AIR transmitted from the hall indicator controller, and for generating/transmitting a car related hall fixture disable signal DIS to the hall indicator controller upon the receipt of a malfunction detecting operation completion signal FIN from the hall indicator controller at a stand-by state; and a plurality of hall indicator controllers for performing the automatic malfunction detection process by sequentially activating every car related hall fixtures upon the receipt of the EN, ST from the main controller, for generating/transmitting FIN via a transmission line to the main controller if the automatic malfunction detection operation is completed.

To achieve another object, the present invention is provided with a method for detecting malfunction of car-related hall fixtures and of car fixtures in an elevator system where a plurality of elevator cars are operating separately from each other, if a repair & malfunction detection mode is set in the system, deactivating display functions of a plurality of car-related hall fixtures at every floor landing as well as car fixtures whose car is selected for a malfunction detection operation so as to prevent a plurality of passengers from getting into the selected elevator car at any floor landing, comprising steps of: (a) selecting a desirable floor landing for malfunction detection operation and controlling display functions of car related hall fixtures at the selected floor landing, in which as an elevator car is stopped at a floor landing after a repair & malfunction detection operation mode is set, wherein a determination is made whether or not a signal for selecting an automatic malfunction detection operation mode is entered; and if a signal for selecting an automatic malfunction detection operation mode is determined to be entered, transmitting EN and ST to the hall indicator controller on the floor landing at which the elevator car is stopped whereby the automatic malfunction detection operation can take place, and in which if either the signal for selecting the automatic malfunction detection operation is not received, or the signal indicative of completion of the automatic malfunction detection operation is received under the circumstance of the repair & malfunction detection mode, a generation/transmission of a DIS signal to the hall indicator controller at the floor landing at which the elevator car is stopped is made whereby the plurality of car related hall fixtures are not operable, so that a plurality of passengers are prevented from getting into the respective elevator car; and (b) checking malfunctions of the plurality of car related hall fixtures in order according to a predetermined program upon the receipt of EN along with ST.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above objects and other advantages of the present invention will become more apparent by describing in detail the preferred embodiment thereof with reference to the attached drawings, in which.

DETAILED DESCRIPTION OF THE PREFERRED EMBODIMENTS

An embodiment of the present invention will now be described with reference to the accompanying drawings.

Figure 1:
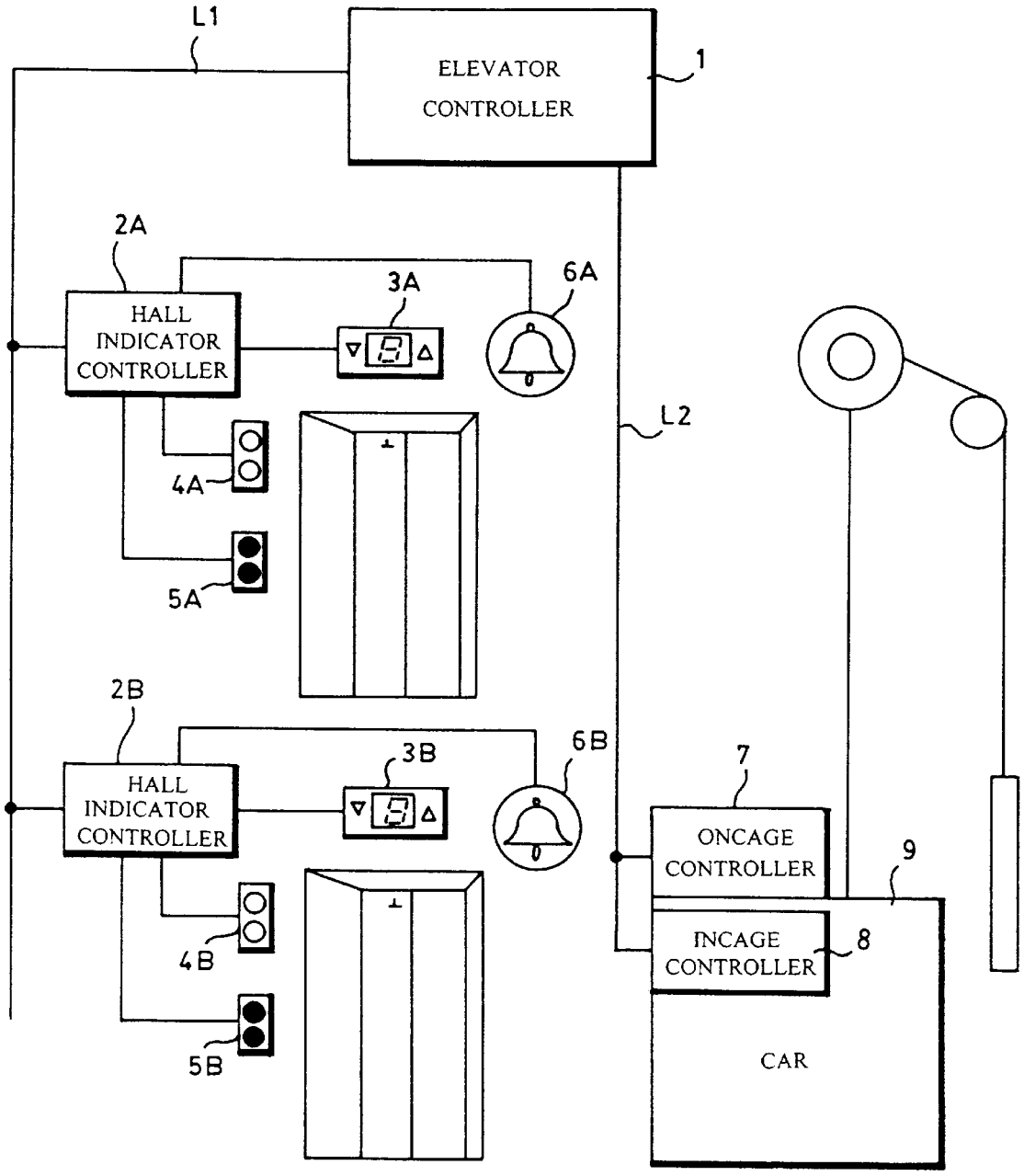
FIG. 1 (CONVENTIONAL ART)
FIG. 1 is a schematic block diagram showing the construction of a conventional apparatus and method for detecting malfunction in a distributed malfunction detecting system.
Figure 2:
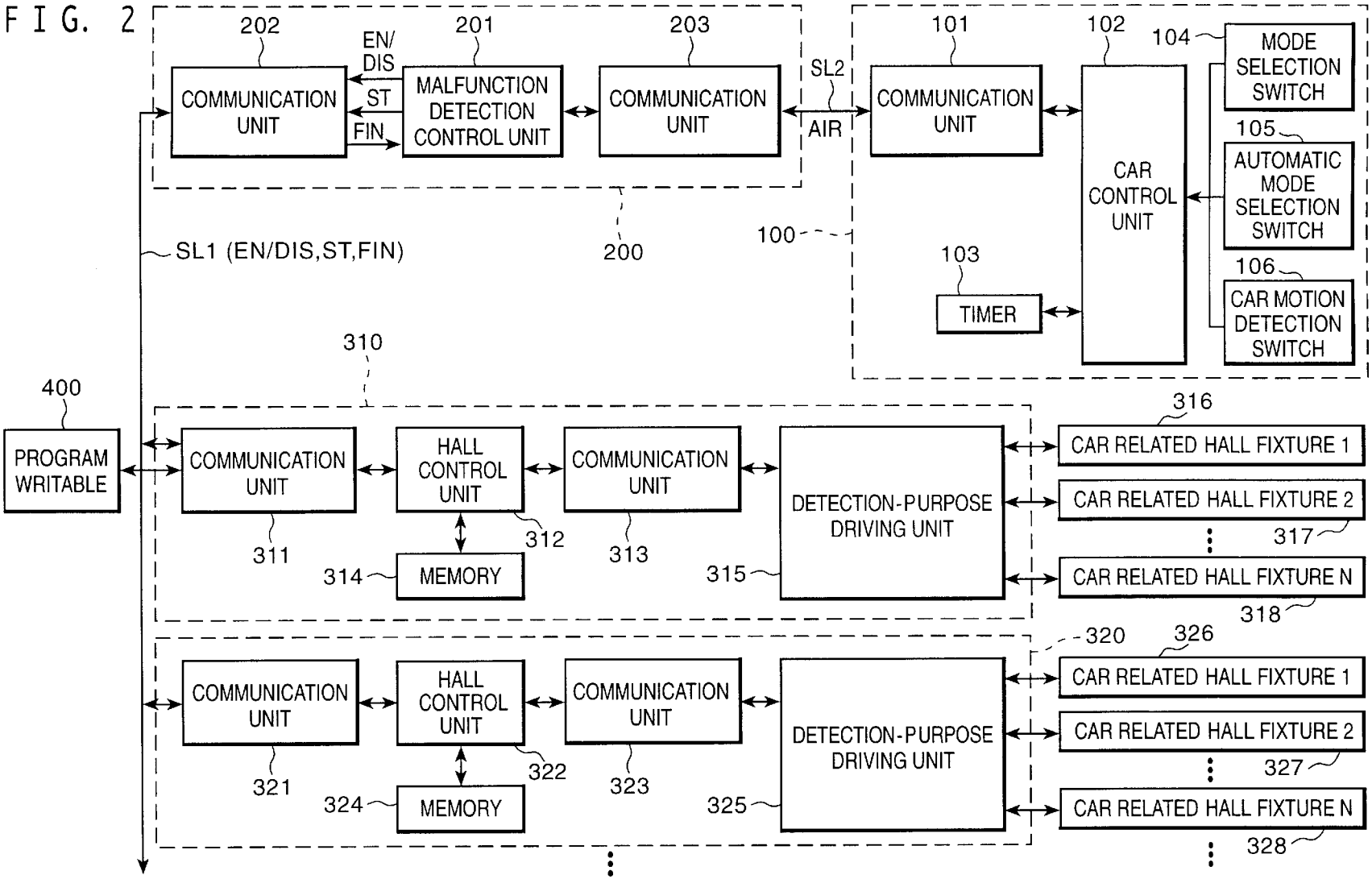
FIG. 2 is a block diagram showing the construction of an apparatus and method for detecting malfunction in a distributed malfunction detecting system according to an embodiment of the present invention.

FIG. 2 is a block diagram showing the construction of an apparatus for detecting malfunctions according to an embodiment of the present invention. The apparatus according to the embodiment of the present invention performs its malfunction detecting function through communication among various controllers 100, 200, 310, 320, . . . , in which under a repair & malfunction detection mode, display functions of a plurality of car-related hall fixtures connected to the respective hall indicator controller are not operable so as to prevent passengers from getting into the selected elevator car, and in which elevator cars are providing service to passengers in turn resulting from the fact that the system is capable of controlling a plurality of elevator cars to operate separately from each other. As described above, although the apparatus of the present invention applies to the distributed malfunction detecting system, the whole system is not shown. Only the main parts of apparatus according to the present invention are shown in FIG. 2.

Referring still to FIG. 2, the apparatus comprises an elevator controller 100, a main controller 200, and a plurality of hall indicator controllers, 320, . . . , 3N0 (310 N denotes the number of floor landings in the respective building). The elevator controller 100 comprises a mode selection switch 104 for selecting between a normal operation mode and a repair & malfunction-detection mode for a certain elevator car; an automatic mode selection switch 105 for selecting an automatic repair & malfunction-detection mode after a repair & malfunction detection mode is set; a car motion detection switch 106 for detecting a position at which an elevator car is stopped with the use of output signals from a limit switch which checks whether or not a car door is opened; a car control unit 102 for processing all of the entry data from switches and sensors disposed on the ceiling of an elevator car as well as from various switches disposed on a wall of an elevator car, and incoming car calls, and for controlling operations of a plurality of car-related hall fixtures; a communication unit 101 connected to both the communication unit 203 and the car control unit 102 for mutual data exchange; and a timer 103 for measuring time so as to transmit an Automatic repair & malfunction-detection mode Interrupt Request signal AIR via a transmission line SL2 to the main controller 200 at a predetermined time.

The main controller 200 comprises a malfunction detection control unit 201, a communication unit 202, and the communication unit 203 for generating/ transmitting the respective car related hall fixture enable signals EN along with a malfunction detecting operation start command ST through a transmission line SL1 to the respective hall indicator controller 310, 320 . . . located on each floor (at which a car is stopped), wherein a maintenance officer wishes to perform a malfunction-detecting job on a plurality of hall fixtures, in response to the incoming Automatic repair & malfunction-detecting mode Interrupt Request signal AIR transmitted via the transmission line SL2 from the elevator controller 100 in the event of selecting a repair & malfunction-detection mode, and for generating/ transmitting car related hall fixtures disable signal DIS via the transmission line SL1 to the previously selected hall indicator controller 310, 320, . . . upon the receipt of malfunction detecting operation completion signal FIN from the present hall indicator controller 310, the present hall indicator controller 310 transmitting FIN after a certain amount of time in a stand-by until a repair & malfunction-detecting job on a plurality of car-related hall fixtures connected to the hall indicator controller 310 is completed, so as to disable a plurality of car related hall fixtures connected to the hall indicator controller, whereby a plurality of passengers are informed that the respective elevator car is not operating.

The hall indicator controllers 310, 320, . . . , 3N0 respectively comprise communication units 311, 321, . . . for mutual data exchange with an external device; communication units 313, 323, . . . for mutual data exchange with various car-related hall fixtures; detection-purpose driving units 315, 325, . . . connected to a plurality of various car-related hall fixtures 316~318, 326~328, . . . for sequentially driving the respective car related hall fixtures; memories 314, 324, . . . for storing malfunction-detecting programs (comprising a plurality of desirably different program routines for each of the car-related hall fixtures, each program routine being suitable for checking up an operation of the corresponding car-related hall fixture according to its unique characteristics) specifying a set execution time indicative of such as an activation time for each of the car-related hall fixtures, and of the set routine determining the execution order for a plurality of car-related hall fixtures; hall control units 312, 322, . . . for controlling to sequentially execute the repair & malfunction-detecting operation on each of the car-related hall fixtures by running the respective program previously stored in the memory means upon the receipt of the EN signal along with the ST signal from the main controller 200, and for generating/transmitting a FIN signal via the transmission line SL1 to the main controller 200 when the malfunction-detecting operations on every car-related hall fixtures on the respective floor landing is completed.

The communication units 203 and 101 provide serial communication between the main controller 200 and the elevator controller 100, and the communication units 202 and 311, 321, . . . , 3N1 provide serial communication between the main controller 200 and the plurality of hall indicator controllers 310, 320, . . . , 3N0. Further, for the sake of convenience of the maintenance officer, the memories 314, 324, . . . can be rewritten with any other program writable unit 400 (for example, a laptop computer), the program writable unit 400 is connected to the plurality of memories 314, 324, . . . , 3N4 via the plurality of communication units 311, 321, . . . , 3N1 to cause some contents of programs already stored in the memories of the plurality of hall indicator controllers to be loaded with new contents as the maintenance officer desires, whereas sometimes the program instructions are specified read only, in another word, can not be changed. It is apparent that the program writable unit 400, such as a laptop computer, etc., is not needed in the latter case.

Referring still to FIG. 2, even though the apparatus comprises a plurality of hall indicator controllers installed at every floor landing in the building, only the two hall indicator controllers 310, 320 are shown, ones in the top terminal floor landing and the second top terminal floor landing respectively.

Figure 3:
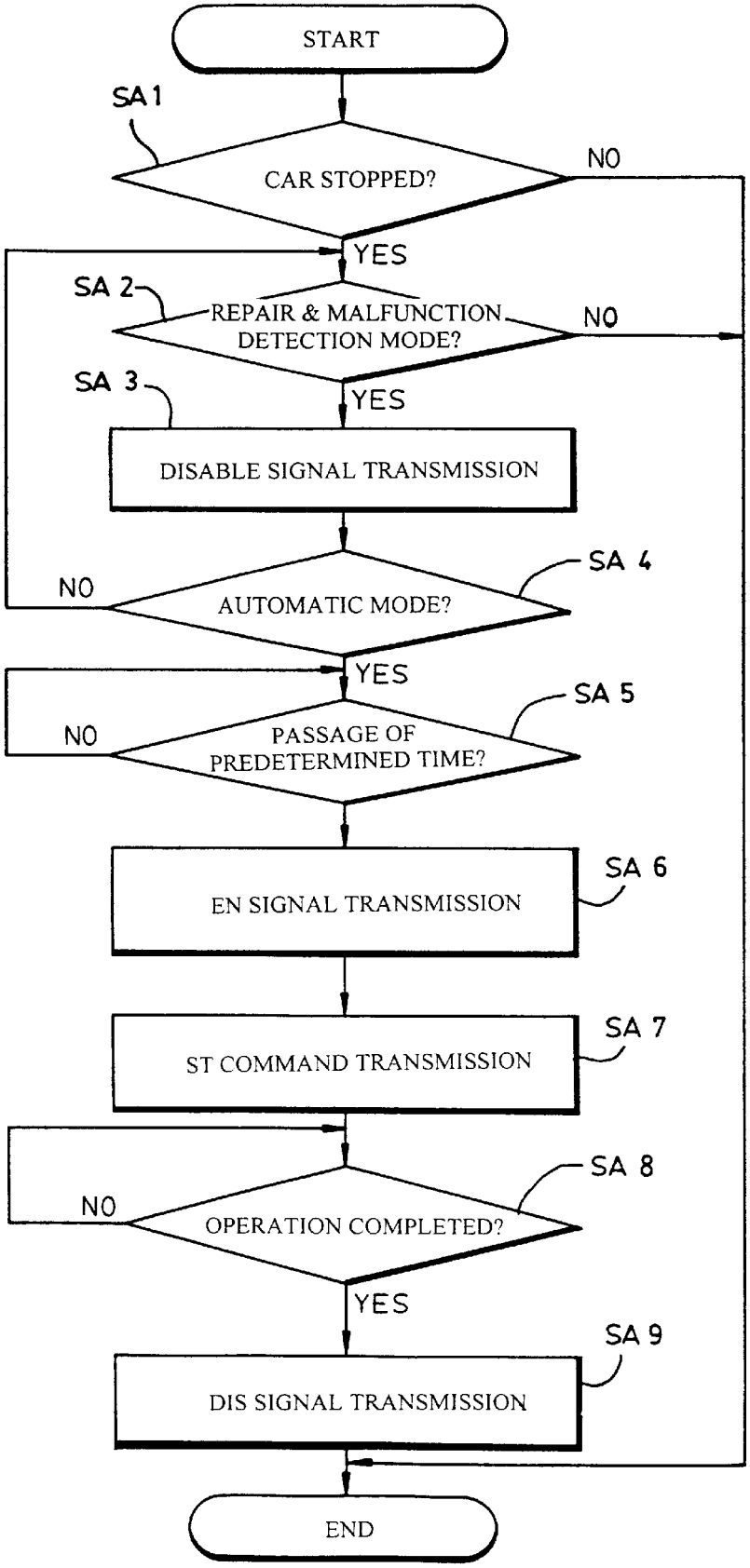
FIG. 3 is a flowchart for explaining the operation of the group controller shown in FIG. 2 in the repair & malfunction detecting mode.

FIG. 3 is a flowchart for explaining the main operations of the malfunction detection control unit 201 of the main controller 200 shown in FIG. 2 under the repair & malfunction detection mode. Referring to FIG. 3, a series of operations of the main controller 200 will be described in detail. The malfunction detection control unit 201 determines whether or not the elevator car is stopped, in Step SA1. If the elevator car is stopped, the malfunction detection control unit 201 determines whether or not the repair & malfunction-detecting mode selection signal is inputted from the mode selection switch 104 (FIG. 2, shows only one elevator controller 100 for an elevator car), in Step SA2. If the repair & malfunction detection mode is determined to be set based on the repair & malfunction detecting mode selection signal, the malfunction detection control unit 201 transmits DIS signal via a transmission line SL1 to a plurality of hall indicator controllers 310, 320, . . . at every floor landing, in Step SA3. The malfunction detection control unit 201 thereafter determines whether or not an AIR signal is received from the automatic mode selection switch 105, in Step SA4. If the AIR signal is received, Step SA5 is executed to determine whether or not a certain amount of time has passed after an elevator car door is opened. The malfunction detection control unit 201 executes Step SA6 of generating/transmitting a respective car related hall fixture enable signal EN to the respective hall indicator controller on the selected floor landing, and thereafter executes Step SA7 of generating/transmitting a respective malfunction detecting operation start command ST through the transmission line SL1 to the respective hall indicator controller. The malfunction detection control unit 201 executes Step SA8 to determine, on the basis of the output signal of a repair & malfunction detecting operation completion signal FIN from the respective hall indicator controller, whether or not the repair & malfunction detection operation on the various car-related hall fixtures on the selected floor landing is completed. The malfunction detection control unit 201 executes Step SA9 of generating/transmitting a car related hall fixture disable signal DIS via the transmission line SL1 to the hall indicator controller whose car related hall fixtures just completed a malfunction detection operation. On the other hand, if the AIR signal is not received by the malfunction detection control unit 201, the process returns to Step SA2.

In brief, according to the present invention, the method for detecting malfunction may be broadly categorized into three steps comprising of:

(a) selecting an automatic malfunction detecting mode by determining whether or not the AIR is transmitted from the automatic/manual mode selection switch disposed in the elevator controller (SA1~SA2);

(b) controlling a plurality of hall indicator controllers to make car related hall fixtures connected to itself to be disabled(SA3);

(c) activating a plurality of car related hall fixtures of the selected elevator car on the floor by floor basis by transmitting EN and ST signals to the hall indicator controller located on the selected floor landing, whereby a plurality of car-related hall fixtures on the respective floor landing are activated (SA4~SA7);

(d) disabling the plurality of car related hall fixtures on the floor landing previously selected for malfunction detection operation, by transmitting DIS signal to the respective hall indicator controller upon the receipt of the FIN signal from the hall indicator controller, whereby the car related hall fixtures are not operable on the floor landing where the malfunction detection operation is completed, whereas being in a stand-by condition until the FIN signal is generated (SA8, SA9).

Figure 4:
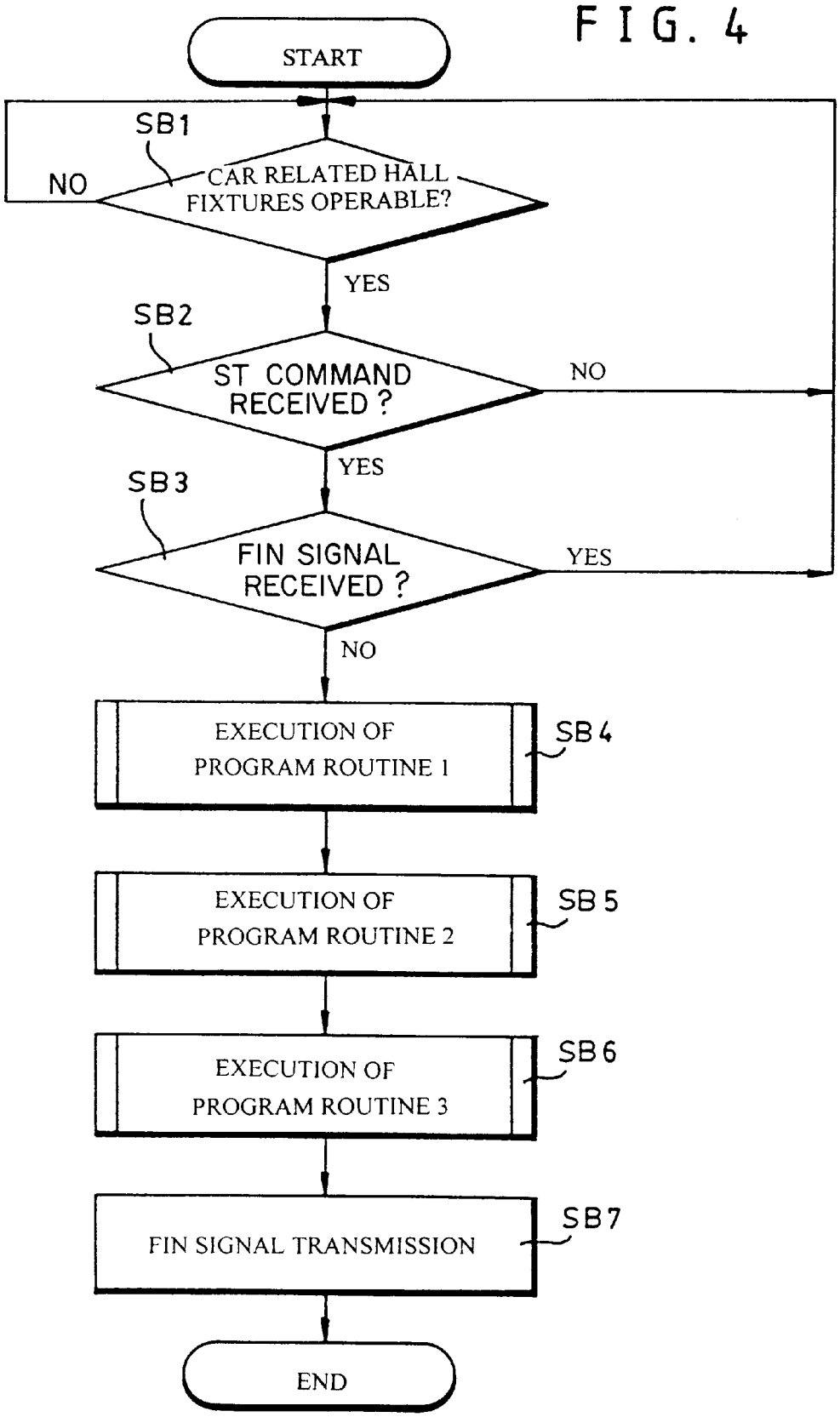
FIG. 4 is a flowchart for explaining the operation of the hall indicator controller shown in FIG. 2 in the repair & malfunction detecting mode.

FIG. 4 is a flowchart for explaining the operation of the hall indicator controller 310 shown in FIG. 2 under the repair & malfunction detection mode. As shown in FIG. 4, for example, the hall indicator controller 310 for the selected elevator car on the selected floor landing determines whether or not the respective car related hall fixtures 316–318 attached to the corresponding hall indicator controller are all enabled in Step SB1. If all of the car-related hall fixtures 316–318 are enabled, Step SB2 determine whether or not the malfunction detecting operation start command ST is received. On the other hand, if any of the car-related hall fixtures 316–318 is not enabled in Step SB1, Step SB1 is again executed. If command ST is received, the hall indicator controller 310 executes Step SB3 to determine whether or not the malfunction-detecting operation completion signal FIN is received. If command ST is not received in Step SB2, Step SB1 is re-executed. If FIN is received, Step SB1 is again executed. On the other hand, if FIN signal is not received, Step SB4 is executed, in which the first program routine performing a malfunction detection operation on the first selected car related hall fixture (in the preferred exemplary embodiment, 316) is executed. After Step SB4 is completed, Step SB5 is executed, in which the second program routine is executed for the next car related hall fixture. Step SB 6 is thereafter executed, in which the third program routine is executed for the second next car related hall fixture. It can be understood that although only three car related hall fixtures are explained in FIG. 4 according to the exemplary embodiment of the present invention a different number of car-related hall fixtures can be tested. After the hall indicator controller 310 determines whether or not the malfunction-detecting operations on every car related hall fixtures are connected to the respective hall indicator controller 310 by running the entire program, the hall indicator controller 310 thereafter transmits a repair & malfunction-detecting operation completion signal FIN to the main controller, in Step SB7, if it is determined that malfunction-detecting operations on every car related hall fixture is completed.

Referring again to FIG. 3, and 4, the apparatus according to the preferred embodiment of the present invention is distributably installed locating in both the main controller 200 and the plurality of hall indicator controllers 310, 320, . . . , 3N0.

For a further explanation of Steps SB4, SB5, and SB6, suppose that a hall position & up/down direction indicator is the first car related hall fixture to be checked up by the first program routine, car arrival indicating hall lanterns are the second car related hall fixtures to be checked up by the second program routine, and the third one is a hall call button lamp to be checked up by the third program routine accordingly. The first program routine is executed for the hall position & up/down direction indicator, in which an up direction indicating lamp is first flickered repetitively three times and then a down direction indicating lamp is flickered in the same way, a plurality of lights from a hall position indicator, each light representing a current service floor position of a respective elevator car, are illuminated in order from a bottom terminal floor landing to a top terminal floor landing, after a full capacity indicator as well as a normal operation mode indicator are also illuminated repetitively three times respectively. Next, the second program routine is executed for car arriving indicating hall lanterns, in which "from up" car arriving indicating hall lantern is illuminated three times, and "from down" car arriving indicating hall lantern is then illuminated three times. Finally, the third program routine is executed for hall call button lamps, in which the up hall call button lamp is illuminated repetitively three times, and the down hall call button lamp is then illuminated in the same way as well. In the event that chime bells are also installed at a hall as a car related hall fixture, another program routine can be executed for them, in which two chime bells. One chime bell notifies the passengers that the respective car is approaching to the service floor landing and another chime bell notifies the passengers that the optimum car (e.g., car closest to the service floor landing) is assigned in the elevator system. These chime bells are respectively sounded repetitively twice, and buzzer sound is added for a very short time between the two chime bells when the bells are checked up so that the maintenance officer can be informed that the change of the chime bells has occurred. While all of those program routines are being executed for all of car related hall fixtures as described above, the elevator maintenance officer does not need to do anything but merely needs to watch them so as to determine whether or not the hall fixtures are operating as previously decided to be operated according to each of the program routines.

Figure 5:
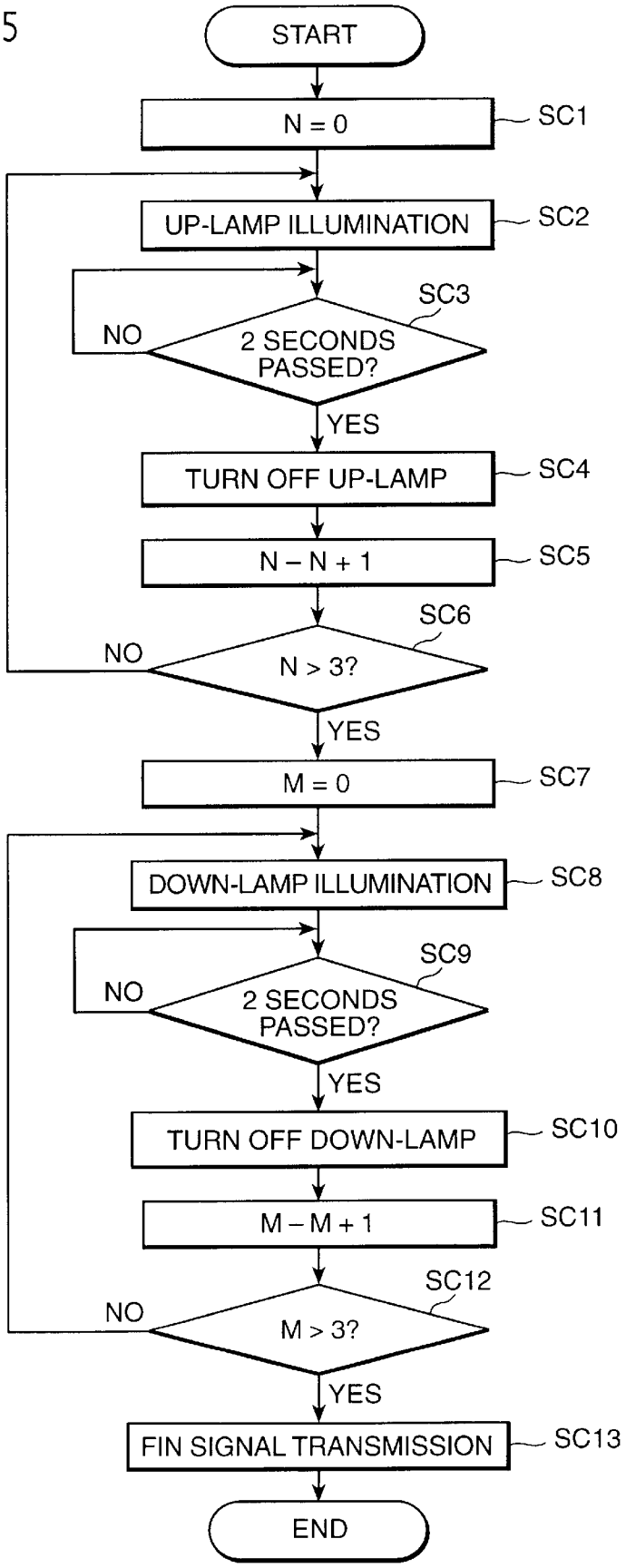
FIG. 5 is a flowchart for explaining an example of the malfunction detection operation on the car related hall fixture 3 shown in FIG. 2.

FIG. 5 is a flowchart for explaining the malfunction detection operation of, for example, the car related hall fixture 316 shown in FIG. 2. By executing the third program routine, the malfunction detection operation of the car related hall fixture 316 (as denoted in figure) will be described in detail with reference to the FIG. 5. Suppose that the car related hall fixture 316 is an up/down direction indicator. Step SB5 is completed, Step SB6 is thereafter beginning. The third program routine is written so as to perform the following malfunction detection operation on the car related hall fixture 316; the number "n" indicative of the number of times an up-direction indicating lamp is flickered is set to "0", in Step SC1. The up-direction indicating lamp is activated to illuminate, in Step SC2. The determination whether or not two seconds has passed since the up-direction indicating lamp has been illuminated is made, in Step SC3. If 2 seconds has passed, the up-direction indicating lamp is turned off, in Step SC4. The number "n" is increased by 1, in Step SC5. The determination whether or not the number "n" is greater than 3 is made, in Step SC6. If "n" is determined not to be greater than 3the, process returns to Step SC2. On the other hand, if "n" is determined to be greater than 3, the number "m" indicative of the number of times a down-direction indicating lamp is flickered is set to "0", in Step SC7. The down-direction indicating lamp is activated to illuminate, in Step SC8. The determination whether or not two seconds has passed since the up-direction indicating lamp has been illuminated is made, in Step SC9. If 2 seconds has passed, the down-direction indicating lamp is turned off, in Step SC10. The number "m" is increased by 1, in Step SC11. The determination whether or not the number "m" is greater than 3 is made, in Step SC12. If "m" is determined not to be greater than 3, the process returns to Step SC8. If "m" is greater than 3, FIN signal is transmitted and output in Step SC13.

In accordance with the present invention described as above, the apparatus is capable of selecting a desirable floor landing, whereby the malfunction detecting operation is automatically processed for all of the plurality of car related hall fixtures on the selected floor landing as well as each car fixture, so that the maintenance officer can complete the malfunction detection test in a very short time, and accordingly can quickly know and repair the malfunctioning car fixture(s).

What is claimed is:

1. An apparatus for detecting malfunctions of car-related hall fixtures in a distributed malfunction detecting system, comprising:

at least one elevator controller, each elevator controller having an automatic mode selection switch for providing an automatic repair & malfunction detection mode interrupt request signal;

a main controller for providing a car-related hall fixture enable signal and an automatic repair & malfunction detection mode operation start command upon receipt of said automatic repair & malfunction detection mode interrupt request signal from said elevator controller and for providing a car-related hall fixture disable signal upon receipt of an automatic repair & malfunction detection mode operation completion signal; and a plurality of hall indicator controllers for performing an automatic repair & malfunction detection mode operation by testing car-related hall fixtures corresponding to the elevator controller according to predetermined programs upon receipt of said car-related hall fixture enable signal and said automatic repair & malfunction detection mode operation start command from said main controller, and for providing said automatic repair & malfunction detection mode operation completion signal to said main controller when said automatic repair & malfunction detection mode operation is completed.

2. A method for detecting malfunction of car-related hall fixtures in an elevator system , comprising:

(a) determining whether or not a signal for selecting an automatic repair & malfunction detection operation mode is received by a main controller to perform a malfunction detection operation on car-related hall fixtures for an elevator car;

(b) transmitting, from the main controller, a car-related hall fixture enable (EN) signal and an automatic repair & malfunction detecting mode start (ST) signal to a hall indicator controller corresponding to the car-related hall fixtures based as a result of the step (a);

(c) generating a car-related hall fixture disable (DIS) signal to the hall indicator controller to prevent entry to the elevator car during the malfunction detection operation; and (d) checking, by the hall indicator controller, malfunctions of the car-related hall fixtures based on predetermined programs upon receipt of said EN signal and said ST signal.

3. The method as claimed in claim 2, further comprising:

selecting the automatic repair & malfunction detection operation mode by determining whether or not an automatic repair & malfunction detecting mode interrupt request signal is transmitted from an automatic mode selection switch disposed in an elevator controller to the main controller.

4. The method as claimed in claim 2, wherein said step (d) includes the steps of:

(d1) determining whether or not to perform the automatic malfunction detection operation on the car-related hall fixtures based on the EN signal and the ST signal; and (d2) performing the automatic malfunction detection operation on the car-related hall fixtures in a predetermined order according to the predetermined programs.

5. The method as claimed in claim 4, wherein said step (d2) illuminates each of the car-related hall fixtures a predetermined number of times for a predetermined period of time.

6. The method as claimed in claim 3, further comprising:

(e) activating the car-related hall fixtures based on the EN signal and the ST signal; and (f) disabling a plurality of car-related hall fixtures on a floor landing previously selected for a malfunction detection operation based on the DIS signal.

7. The method as claimed in claim 4, further comprising:

(e) generating a malfunction detection operation completion (FIN) signal indicative of a completion of the automatic malfunction detection operation based on a result of said step (d2).

8. The apparatus as claimed in claim 1, wherein the elevator controller further includes:

a mode selection switch for selecting between a normal operation and a repair & malfunction detection mode.

9. The apparatus as claimed in claim 8, wherein the elevator controller further includes:

a car motion detection switch for detecting a position of an elevator car, and a communication unit for transmitting and receiving data to and from the main controller.

10. The apparatus as claimed in claim 9, wherein the communication unit transmits outputs of the automatic mode selection switch, the mode selection switch, and the car motion detection switch to the main controller.

11. The apparatus as claimed in claim 9, wherein the main controller includes:

a first communication unit for communicating with the communication unit of the elevator controller.

12. The apparatus as claimed in claim 11, wherein the main controller further includes:

a malfunction detection control unit for generating the car-related hall fixture enable signal and the automatic repair & malfunction detection mode operation start command based on an output of the first communication unit, and a second communication unit for transmitting the car-related hall fixture enable signal and the automatic repair & malfunction detection mode operation start command to the plurality of hall indicator controllers, and receiving the automatic repair & malfunction detection mode operation completion signal from the plurality of hall indicator controllers.

13. The apparatus as claimed in claim 1, wherein each of the hall indicator controllers includes a memory for storing therein the predetermined programs.

14. The apparatus as claimed in claim 13, further comprising:

a program writable unit for modifying the programs stored in the memory of each hall indicator controller.

* * * * *